United States Patent [19]

Ishigaki et al.

[11] 4,412,097

[45] Oct. 25, 1983

[54] VARIABLE-DIRECTIVITY MICROPHONE DEVICE

[75] Inventors: Yukinobu Ishigaki, Machida; Kaoru Totsuka, Tokyo; Makoto Yamamoto, Yokosuka; Naotaka Miyaji, Yamato, all of Japan

[73] Assignee: Victor Company of Japan, Ltd., Yokohama, Japan

[21] Appl. No.: 227,035

[22] Filed: Jan. 21, 1981

[30] Foreign Application Priority Data

Jan. 28, 1980 [JP] Japan ..... 55-8681[U]
Jan. 28, 1980 [JP] Japan ..... 55-8682[U]

[51] Int. Cl.[3] ..... H01R 1/10

[52] U.S. Cl. ..... 381/92; 179/121 D; 179/179

[58] Field of Search ..... 179/1 DM, 179, 121 D; 181/31 R

[56] References Cited

U.S. PATENT DOCUMENTS 2,496,031 1/1950 Anderson et al. ..... 177/352
4,308,425 12/1981 Momose et al. ..... 179/1 DM

FOREIGN PATENT DOCUMENTS 2439331 4/1976 Fed. Rep. of Germany ... 179/1 DM
2931604 of 0000 Fed. Rep. of Germany .
2050111 4/1980 United Kingdom .

OTHER PUBLICATIONS

Farrar, K., *Soundfield Microphone-2* Wireless World, 11/79, pp. 99-103.

*Primary Examiner*—G. Z. Rubinson
*Assistant Examiner*—Robert Lev
*Attorney, Agent, or Firm*—Ladas & Parry

[57] ABSTRACT

A variable directivity microphone device comprises a microphone unit assembly provided and arranged with at least three microphone units, wherein the three microphone units are mutually separated by predetermined distances, and front faces of a first and second microphone units of the three microphone units are provided and arranged facing the front surface of the microphone unit assembly while the front face of a third microphone unit is provided and arranged in a direction opposite to those of the first and second microphone units, a first and second variable resistors respectively having a terminal at one end, an intermediate terminal, and a terminal at the other end, wherein respective sliders are mutually linked or ganged and movable between a first, second, and third positions corresponding to the terminals, where the first variable resistor has the terminals at both ends thereof respectively connected to the output sides of the second and third microphone units and the intermediate terminal thereof connected to ground, an adder for adding and mixing the output of the first microphone unit and a signal obtained from the slider of the first variable resistor, and a frequency characteristic compensating circuit having an operational amplifier, for compensating for the frequency characteristic of the output signal of said adder. The second variable resistor has the terminals at both ends thereof respectively connected between the output side and input side of the operational amplifier, and the slider thereof connected to the output side of the operational amplifier. The frequency characteristic compensating circuit further comprises a frequency characteristic circuit connected in parallel with the second variable resistor, and the microphone device varied of its directivity from non-directivity, to primary unidirectivity, and then to secondary unidirectivity, as the sliders of the first and second variable resistors vary from the above first, to second, and then to third positions.

2 Claims, 5 Drawing Figures

23
21
22
OP AMP
ADD
19
16
PRE AMP
VR2
VR1
R1
R2
R3
R4
C1
C2
C3
12
13
15
14
11
11a
18
PRE AMP
30
INV AMP
24
R13
R11
R12
C11
28
OP AMP
20

VARIABLE-DIRECTIVITY MICROPHONE DEVICE

BACKGROUND OF THE INVENTION

The present invention relates generally to variable-directivity microphone devices, and more particularly to a variable-directivity microphone device in which at least three unidirective microphone units are combined in a specific arrangement, and the respective output signals of these microphone units are mixed with varied mixing ratios, whereby the directivity is widely varied, to perform zooming of the acoustic or sound image with ample sense of distance change as sensed by the listener, by use of variable resistors having a simple construction.

Heretofore, as a microphone device capable of varying the directivity, there has been a microphone device having an arrangement wherein two unidirective microphones are disposed opposing each other, and their outputs are mixed with varied mixing ratios. In this device, a final output signal is obtained by varying the mixing ratio to thus vary the directivity of the microphone device, from a state of non-directivity to bidirectivity, up to unidirectivity.

However, in this known microphone device, the range of variation of the directivity is narrow, and hence, there is a drawback in that it is impossible to obtain an acoustic image zooming effect with ample sense of the change in distance.

Accordingly, in order to overcome the above drawback, there was has proposed a "VARIABLE-DIRECTIVITY MICROPHONE DEVICE" in the U.S. patent application Ser. No. 142,845 now U.S. Pat. No. 4,308,425 which is assigned to the assignee of the present invention. In this previously proposed device, three primary sound-pressure gradient unidirective microphone units are arranged in a specific combination of positional relationship, and the respective outputs of the microphone units are mixed with varied mixing ratios. In the above device, the directivity can be varied within a wide range from a state of non-directivity to primary sound-pressure gradient unidirectivity and secondary sound-pressure gradient unidirectivity (referred to as secondary unidirectivity hereinafter). Furthermore, accompanied by the variation in the directivity, variation of the volume (zooming of the acoustic image) is possible while imparting an ample sense of distance change.

However, in this previously proposed microphone device, two variable resistors for varying the mixing quantity (the radio with which respective outputs of the microphones are mixed) which are respectively connected to two microphones to vary the above directivity and volume, two variable resistors for varying the mixed signal level of the outputs of three microphones, and a variable resistor for varying the frequency characteristic of a circuit for compensating the mixed signal frequency characteristic, that is, a total of five variable resistors are required. Hence, a variable resistor having a special construction comprising four ganged variable resistors in which the variable resistors respectively undergo different variation in resistance, must be used. The disadvantages of this approach are that the circuit cannot be constructed on a small scale and with low cost, and a large torque is required to drive the variable resistors.

SUMMARY OF THE INVENTION

Accordingly, a general object of the present invention is to provide a novel and useful variable-directivity microphone device in which the above described disadvantages have been overcome.

Another and more specific object of the present invention is to provide a variable-directivity microphone device in which at least three primary sound-pressure gradient unidirective microphone units are arranged in a specific combination of positional relationship, and the respective outputs of the microphone units are mixed with varied mixing ratios, having variable resistors of simple construction. In the device according to the invention, the directivity can be varied within a wide range from a state of non-directivity to primary sound-pressure gradient undirectivity and multiple-order sound-pressure gradient unidirectivity above the secondary. Furthermore, zooming of the acoustic image is possible while imparting an ample sense of distance change, and since the variable resistors can be of the two-ganged type, the circuit can be simply constructed on a small scale at low cost.

Still another object of the present invention is to provide a variable-directivity microphone device in which the outputs of the forward-facing microphone unit and the rearward-facing microphone unit of the above three microphone units, are subjected to inverse-phase addition in the high-frequency range and subjected to in-phase addition in the low-frequency range, and the output of one microphone unit is mixed with the output of the other microphone unit through a phase shifting circuit, further enabling the simple construction of a variable resistor for varying the above mixing quantity. According to the device of the present invention, the compensation quantity of a frequency compensation circuit can be made small, and the signal-to-noise (S/N) ratio can be improved, since the level loss especially in the low frequency range can be eliminated.

Other objects and further features of the present invention will be apparent from the following detailed description when read in conjunction with the accompanying drawings.

DETAILED DESCRIPTION

Figure 1:
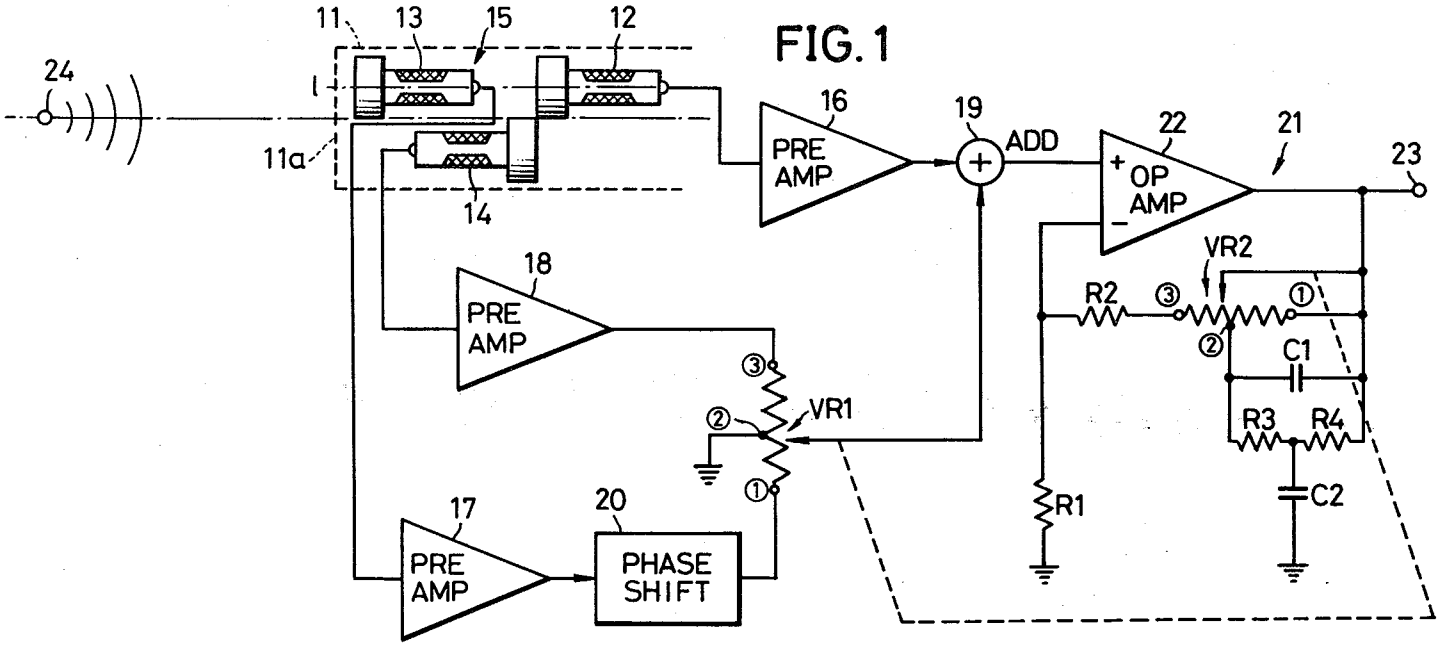
FIG. 1 is a systematic circuit diagram showing a first embodiment of a variable-directivity microphone device according to the present invention.

In FIG. 1, a microphone unit assembly 15 comprising microphone units 12, 13, and 14, is accommodated and fixed within an accommodating cylinder 11. Each of these microphone units 12 through 14 has a primary sound-pressure gradient unidirectivity (hereinafter referred to simply as primary unidirectivity). In the present embodiment of the invention, the microphone units 12 and 13 are positioned in tandem arrangement so that they are directed toward a front face 11*a* of the cylinder 11 having their respective centerlines coincident with a same line l. The microphone unit 12 is positioned so that its diaphragm is, for example, 3 to 4 centi-meters to the rear of the diaphragm of the microphone unit 13. On the other hand, the microphone unit 14 is directed rearward, respectively away from the front face 11*a* of the cylinder, and is positioned so that its centerline is parallel to but laterally offset from line l, and so that its diaphragm lies in the same plane as the diaphragm of the microphone unit 12.

The microphone units 12, 13, and 14 are respectively connected to preamplifiers 16, 17, and 18. The output side of the preamplifier 16 is connected to an adder 19. The output side of the preamplifier 17 is connected to a terminal ① at one end of a variable resistor VR1 through a phase-shifter 20. Furthermore, the output side of the preamplifier 18 is connected to a terminal ③ at the other end of the variable resistor VR1. An intermediate terminal ② of the variable resistor VR1 is grounded, and a slider is connected to the adder 19.

The adder 19 is connected to a non-inverting input terminal of an operational amplifier 22 which is part of a frequency characteristic compensating circuit 21. A circuit comprising resistors R1 through R4, a variable resistor VR2, and capacitors C1 and C2, is connected between the output side and an inverting input terminal of the operational amplifier 22. The variable resistors VR1 and VR2 respectively comprise two ganged variable resistors having center taps. Moreover, a terminal ① of the variable resistor VR2 is connected to the output side of the operational amplifier 22, and a terminal 3 is connected to the inverting input terminal of the operational amplifier 22 through the resistor R2. The resistor R1 is connected between the above inverting input terminal of the operational amplifier 22 and ground. Furthermore, a parallel circuit comprising the capacitor C1 and the resistors R3 and R4 is connected between the terminal ① and an intermediate terminal ② of the variable resistor VR2, and the capacitor C2 to connected between ground and the connection point between the resistors R3 and R4.

Figure 2:
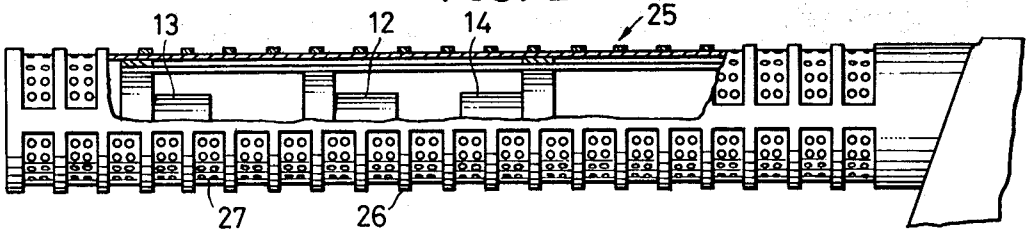
FIG. 2 is a side view with a part cut away, showing an example of the microphone arrangement.

Further, the microphone unit assembly can be constructed from a device shown in FIG. 2. In this example, the three microphone units 12, 13, and 14 are accommodated within a housing 25 so that the centerlines of the forward-facing microphone units 12 and 13 and the rearward-facing microphone unit 14 respectively lie on a single line. The housing 25 comprises a frame structure 26 having a plurality of openings and punching metals 27 provided on the peripheral surfaces and the front surface of the housing.

Moreover, the variable resistors VR1 and VR2 may be of the type having rotating sliders, as in the above described embodiments of the invention, or they may be of the type having sliders which vary the resistance when moved translationally.

In the above described circuit, when first obtaining non-directivity, the sliders of the variable resistors VR1 and VR2 are respectively displaced in a sliding manner into the position at the terminal ③. Accordingly, the output of the microphone unit 14 in its maximum level state which has pass through the preamplifier 18 and the output of the microphone unit 15 in its minimum level state which has passed through the preamplifier 17 and the phase shifting circuit 20, and the output of the microphone unit 12 which has passed through the preamplifier 16, are respectively added and mixed and a minimum level state, at the adder 19. The output signal of this adder 19 is obtained from an output terminal 23 through the frequency characteristic compensating circuit 21. In the above case, the frequency characteristic of the frequency characteristic compensating circuit 21 is flat, since the circuit comprising capacitors C1 and C2 and resistors R3 and R4 is short-circuited through the slider of the variable resistor VR2 positioned at the terminal ③, at the frequency characteristic compensating circuit 21. Next, when obtaining primary unidirectivity, the sliders of the variable resistors VR1 and VR2 are respectively displaced in a sliding manner into the position at the terminal ②. Since the outputs of the microphone units 13 and 14 which have passed through the preamplifiers 17 and 18, are grounded through the terminal ② of the variable resistor VR1, output cannot be obtained from the slider. Accordingly, only the output of the microphone unit 12 is obtained from the output terminal 23, through the preamplifier 16, adder 19, and frequency characteristic compensating circuit 21. Then, the circuit comprising the capacitors C1 and C2 and the resistors R3 and R4 is short-circuited through the slider of the variable resistor VR2 as in the above case, and hence, the frequency characteristic of the frequency characteristic compensating circuit 21 is flat.

During displacement of the slider of the variable resistor VR1 from the terminal ③ to terminal ②, the output of the microphone unit 13 is grounded through the terminal 2, and only the output of the microphone unit 14 is mixed with the output of the microphone unit 12. Thus, the directivity of the microphone device gradually changes from non-directivity to primary unidirectivity, because the output of the microphone unit 14 gradually becomes small. Furthermore, the feed-back quantity of the operational amplifier 22 varies as a result of the variation in the resistance of the variable resistor VR2, and thus, the mixed output level of the microphone units 12 and 14 from the adder 19 which passes through the frequency characteristic compensating circuit 21 gradually becomes high.

Next, when obtaining secondary unidirectivity, the sliders of the variable resistors VR1 and VR2 are displaced in a sliding manner into the position at the terminal ①. The output of the microphone unit 13 which is added with the output of the microphone unit 12 at the adder 19 becomes a maximum value, and the output of the microphone unit 14 becomes a minimum value.

Figures 3A, 5:
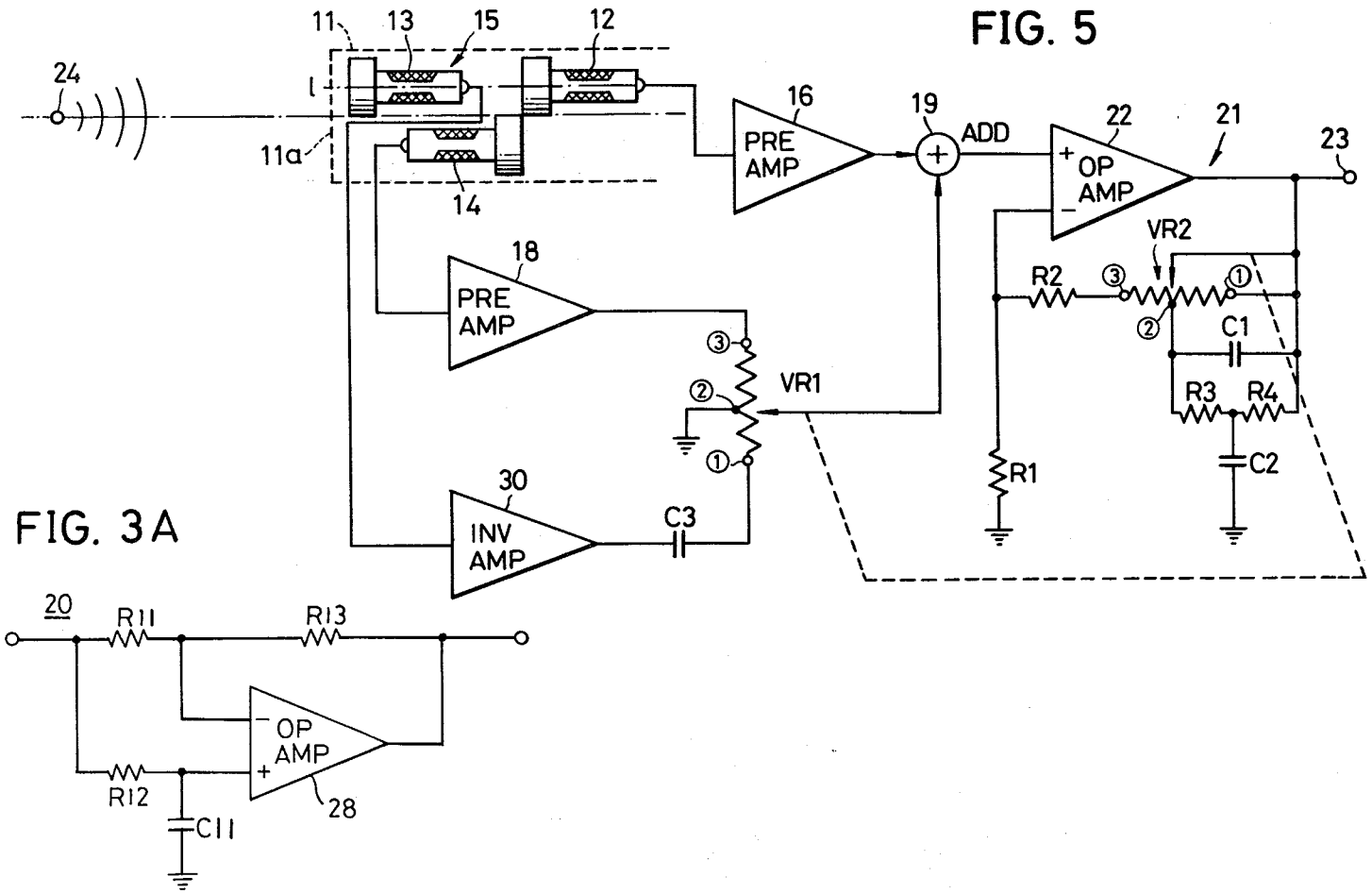
FIGS. 3A and 3B are a circuit diagram and a graph respectively showing an example of a phase-shifter within the circuit system of FIG. 1, and its phase characteristic.
FIG. 5 is a systematic circuit diagram showing a second embodiment of a variable-directivity microphone device according to the present invention.
Figure 3B:
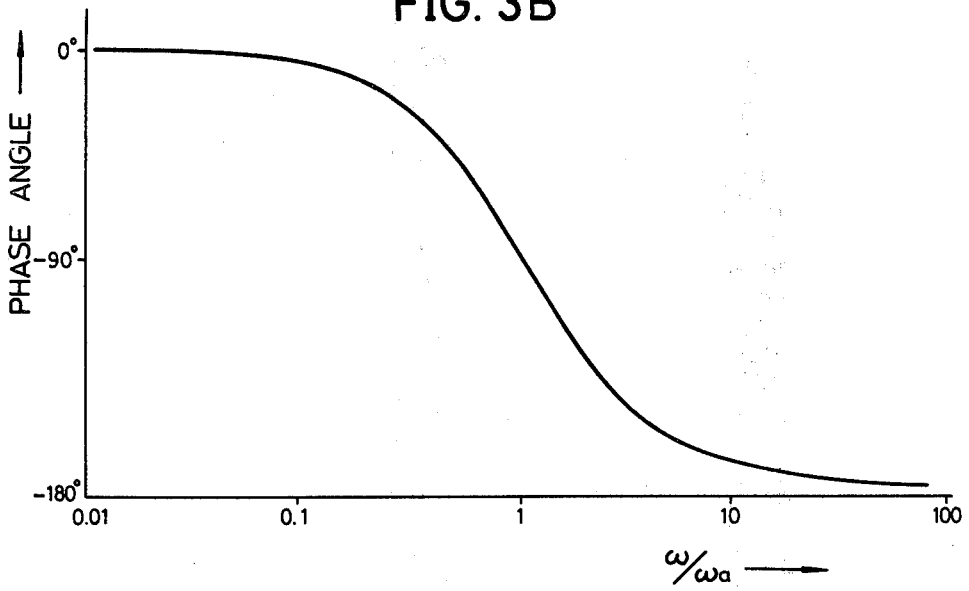

The phase-shifter 20 comprises, for example, an operational amplifier 28 connected as shown in FIG. 3A, resistors R11 through R13, and a capacitor C11, and possesses a phase characteristic as shown in FIG. 3B. This phase characteristic shows on the frequency axis, the phase-shift larger than −90 degrees towards the −180 degrees direction as the ratio $\omega/\omega_a$ of the angular frequency $\omega$ and the angular frequency $\omega_a$ at a point lagging in phase by 90 degrees, becomes larger than unity, and the phase-shift smaller than −90 degrees towards the 0 degree direction as the ratio $\omega/\omega_a$ becomes less than unity. Accordingly, among the signals passed through the phase-shifter 20, the signal component in the frequency band range (high-frequency band range) where the ratio $\omega/\omega_a$ is larger than unity is phase-shifted by 180 degrees, and the signal component in the frequency range (low-frequency range) where the ratio $\omega/\omega_a$ is less than unity is hardly phase-shifted.

Therefore, as far as the high-frequency range component is concerned, the output of the microphone 13 is phase-inverted, and added to the output of the microphone 12 (that is, subtraction is performed between the output of the microphone 13 and the output of the microphone 12).

On the other hand, as far as the low-frequency range component is concerned, the output of the microphone 13 is not phase-inverted, and added to the output of the microphone 12 as it is. Accordingly, when the wavelength of the incoming sound waves to the microphones 13 and 12 is in a low-frequency range large enough so that the separation distance between the two microphones can be neglected, the outputs of the microphones 13 and 12 are added, which means that an output twice that of the microphone 13 or 12 can be obtained. Therefore, in this low-frequency range, a flat characteristic substantially identical to that of a primary unidirectivity microphone can be obtained, and there is no attenuation. In obtaining the above secondary unidirectivity, a case where a frequency at which the ratio $\omega/\omega_a$ becomes equal to one is 50 Hz, the distance between the microphone units 12 and 13 is 3 centi-meters, and the angle formed between the microphone units 12 through 14 and the sound source 24 is zero and 90 degrees, as shown in the frequency characteristic diagram shown in FIG. 4. As clearly seen from FIG. 4, degradation in the response of the device as in the conventional device, is not seen especially in the low-range and mid-range frequencies. Thus, as evidently seen from the zero-degree characteristic shown in FIG. 4, it is sufficient for the frequency characteristic compensation circuit 21 to be able to compensate for up to approximately 13 dB, and the compensating quantity required accordingly becomes small compared to that of the conventional device.

Accordingly, when the sliders of the variable resistors VR1 and VR2 are displaced in a sliding manner into the position at the terminal ①, at a frequency higher than where the ratio $\omega/\omega_a$ between the angular frequencies is unity, the output of the microphone unit 13 is phase-inversed by 180 degrees at the phase shifter 20 and added with the output of the microphone unit 12, that is, the output of the microphone unit 13 thus undergoes inverse-phase addition with the output of the microphone unit 12, and secondary unidirectivity is thus obtained. In a frequency range where the ratio $\omega/\omega_a$ between the angular frequencies is lower than unity, the outputs of the microphone units 12 and 13 are added in-phase, and hence, primary unidirectivity is obtained.

Moreover, as the slider of the variable resistor VR2 is displaced from the terminal ② to the terminal ①, accompanied by the variation in the resistance of the variable resistor VR2, the mixed output level of the microphone units 12 and 13 from the adder 19 which passes through the frequency characteristic compensating circuit 21 gradually becomes high. In addition, as a result of the impedance variation in the circuit connected between the terminals ① and ② of the variable resistor VR2, the frequency characteristic of the frequency characteristic compensation circuit 21 varies.

The resistances of the resistors R1 and R2 in the frequency characteristic compensating circuit 21 are selected at resistances higher than those of the variable resistor VR2 or the resistances (R3+R4), and the capacitance of the capacitor C1 is selected at a capacitance lower than that of the capacitor C2. Hence, the frequency characteristic of the compensating circuit 21 is determined by the resistances of the variable resistor VR2 and the resistors R1 through R4, and the capacitances of the capacitors C1 and C2.

A second embodiment of a variable-directivity microphone device according to the present invention will now be described in conjunction with FIG. 5. In FIG. 5, those parts which are the same as those corresponding parts in FIG. 1 are designated by the like reference numerals, and their description will be omitted. The output side of the microphone unit 13 is connected to the terminal ① of the variable resistor VR1 through a phase-inverting amplifier 30 and the capacitor C3.

In the present embodiment of the invention, the sliders of the variable resistors VR1 and VR2 are respectively displaced in a sliding manner into positions of the terminals ③ and ②, when obtaining non-directivity and primary unidirectivity. The circuit operation in this case is similar to that in the above described first embodiment of the invention.

Figure 4:
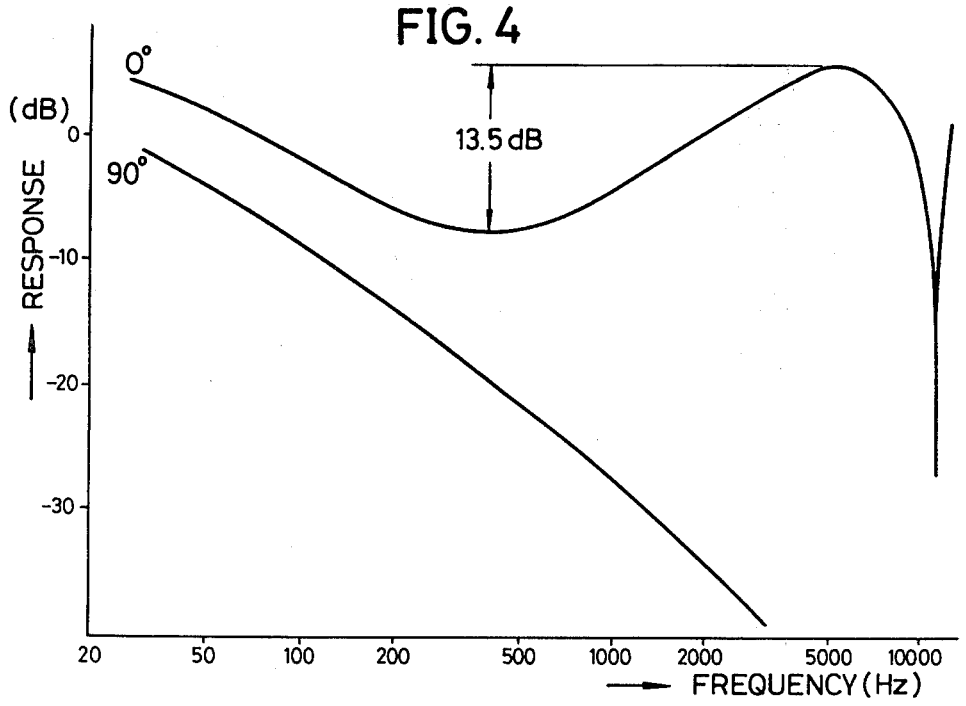
FIG. 4 is a graph showing the frequency characteristic of the output signal of a mixer within the circuit system of FIG. 1.

When obtaining secondary unidirectivity, the sliders of the variable resistors VR1 and VR2 are displaced in a sliding manner into positions of the terminals ①. Accordingly, the output of the microphone unit 14 becomes minimum, and the output of the microphone unit 12 and the output of the microphone unit 13 which has become maximum undergo inverse-phase addition. The capacitor C3 and the variable resistor VR1 substantially comprise a high-pass filter. Hence, in high range frequencies higher than the cut-off frequency of the above high-pass filter, each of the outputs of the microphone units 12 and 13 are mixed in the same level having inverse phases, and thus secondary unidirectivity is obtained. On the other hand, in low range frequencies lower than the cut-off frequency of the high-pass filter, the output of the microphone unit 13 is attenuated, and only the output of the microphone unit 12 is obtained from the adder 19, and thus primary unidirectivity is obtained. In a case where the above cut-off frequency is 100 Hz, the frequency characteristic becomes as shown in FIG. 4.

The construction and operation of the other circuits are the same as those in the first embodiment of the invention, and their descriptions are accordingly omitted.

Furthermore, in the present embodiment of the invention, the phase-inverting amplifier 30 is connected only to the output side of the microphone unit 13, however, the phase-inverting amplifier 30 can be connected to the output sides of the microphone units 14 and 12 instead of being connected to the microphone unit 13. The requirement is that the outputs of the microphone units 13 and 14 are obtained having mutually inverse phases, and the outputs of the microphone units 12 and 13 are obtained having mutually inverse phases.

Further, this invention is not limited to these embodiments but various variations and modifications may be made without departing from the scope of the invention.

What is claimed is:

1. A variable directivity microphone device comprising:

a microphone unit assembly provided and arranged with at least three microphone units, said three microphone units being mutually separated by predetermined distances, and front faces of first and second microphone units among said three microphone units being provided and arranged facing the front surface of said microphone unit assembly while the front face of a third microphone unit is provided and arranged in a direction opposite to those of said first and second microphone units;

a first and second variable resistors respectively having a first terminal at one end, a second intermediate terminal, and a third terminal at the other end, wherein respective sliders are mutually linked or ganged and movable between first, second, and third positions corresponding to said first through third terminals, said first variable resistor having its first and third terminals respectively coupled to outputs of said second and third microphone units and its second intermediate terminal coupled to ground;

a phase-shifter coupled between the output of said second microphone unit and said first terminal of said first variable resistor, for substantially only performing a phase shift in a high-frequency range, said phase-shifter having a phase shifting characteristic wherein the output phase approaches −180 degrees from −90 degrees as a ratio $\omega/\omega_a$ becomes larger than unity and approaches zero degrees from −90 degrees as the ratio $\omega/\omega_a$ becomes smaller than unity, where $\omega$ is the angular frequency and $\omega_a$ is the angular frequency at a point lagging in phase by 90 degrees;

an adder for adding and mixing the output of said first microphone unit and a signal obtained from the slider of said first variable resistor; and a frequency characteristic compensating circuit having an operational amplifier and a frequency characteristic circuit, for compensating for the frequency characteristic of an output signal of said adder, said second variable resistor having its first terminal and slider coupled to an output of said operational amplifier and its third terminal coupled to one input of said operational amplifier, said frequency characteristic circuit being connected in parallel with said second variable resistor between said first and second terminals of said second variable resistor, said microphone device having its directivity varied from non-directivity, to primary unidirectivity, and then to secondary unidirectivity, as the sliders of said first and second variable resistors vary from said third, to second, and then to first positions so that the output phase at said phase-shifter approaches zero degree from −90 degrees and then approaches −180 degrees from −90 degrees.

2. A variable directivity microphone device comprising:

a microphone unit assembly provided and arranged with at least three microphone units, said three microphone units being mutually separated by predetermined distances, and front faces of first and second microphone units among said three microphone units being provided and arranged facing the front surface of said microphone unit assembly while the front face of a third microphone unit is provided and arranged in a direction opposite to those of said first and second microphone units;

a first and second variable resistors respectively having a first terminal at one end, a second intermediate terminal, and a third terminal at the other end, wherein respective sliders are mutually linked or ganged and movable between first, second, and third positions corresponding to said first through third terminals, said first variable resistor having its first and third terminals respectively coupled to outputs of said second and third microphone units and its second intermediate terminal coupled to ground;

a series circuit comprising a phase-inverter and a capacitor, coupled between the output of said second microphone unit and said first terminal of said first variable resistor, said capacitor substantially constituting a highpass filter together with said first variable resistor;

an adder for adding and mixing the output of said first microphone unit and a signal obtained from the slider of said first variable resistor; and a frequency characteristic compensating circuit having an operational amplifier and a frequency characteristic circuit, for compensating for the frequency characteristic of an output signal of said adder, said second variable resistor having its first terminal and slider coupled to an output of said operational amplifier and its third terminal coupled to one input of said operational amplifier, said frequency characteristic circuit being connected in parallel with said second variable resistor between said first and second terminals of said second variable resistor, said microphone device having its directivity varied from non-directivity, to primary unidirectivity, and then to secondary unidirectivity, as the sliders of said first and second variable resistors vary from said third, to second, and then to first positions.

* * * * *